US008225555B2

(12) United States Patent
Magpuri

(10) Patent No.: US 8,225,555 B2
(45) Date of Patent: Jul. 24, 2012

(54) MOTION SIMULATOR THEATER WITH SUSPENDED SEATING

(75) Inventor: Cecil D. Magpuri, Windermere, FL (US)

(73) Assignee: Falcon's Treehouse, L.L.C., Orlando, FL (US)

( * ) Notice: Subject to any disclaimer, the term of this patent is extended or adjusted under 35 U.S.C. 154(b) by 22 days.

(21) Appl. No.: 12/712,606

(22) Filed: Feb. 25, 2010

(65) Prior Publication Data

US 2011/0203190 A1 Aug. 25, 2011

(51) Int. Cl.
*E04H 3/12* (2006.01)
*E04H 3/26* (2006.01)
*E04H 3/10* (2006.01)

(52) U.S. Cl. ..... 52/10; 52/6; 52/7; 52/8; 52/9

(58) Field of Classification Search ..... 52/6–10; 297/446; 472/45, 59, 60, 80
See application file for complete search history.

(56) References Cited

U.S. PATENT DOCUMENTS 1,845,008 A 2/1907 McAdams
1,005,061 A 10/1911 Murie
1,388,130 A 8/1921 Thompson
1,781,058 A 11/1930 Fitzpatrick
1,849,052 A 3/1932 Urling
1,974,035 A 9/1934 Adamson
2,076,113 A 4/1937 Bartlett
2,590,934 A 4/1952 Catlett
3,628,829 A 12/1971 Heilig
3,661,279 A 5/1972 Macrander
3,707,282 A 12/1972 Robinson
3,868,107 A 2/1975 Ichida
4,642,945 A 2/1987 Browning et al.
4,879,849 A 11/1989 Hollingsworth, III et al.
4,976,438 A 12/1990 Tashiro et al.
5,021,954 A 6/1991 Fox et al.
5,161,104 A 11/1992 Fox et al.
5,192,247 A 3/1993 Barr et al.
5,224,425 A 7/1993 Remington
5,277,662 A 1/1994 Fox et al.
5,433,670 A 7/1995 Trumbull
5,453,011 A 9/1995 Feuer et al.
5,611,174 A 3/1997 Hayashi
5,660,000 A 8/1997 MacIntyre
(Continued)

OTHER PUBLICATIONS

United States Patent and Trademark Office, Search Report and Written Opinion for PCT/US11/26011, mailed Apr. 19, 2011.

*Primary Examiner* — Mark Wendell
(74) *Attorney, Agent, or Firm* — Kenneth H. Ohriner; Perkins Coie

(57) ABSTRACT

A motion simulator theater equipped with a passenger carrying apparatus. Passengers move into a boarding space where they board the passenger carrying apparatus, while the passenger carrying apparatus is in a first or boarding position. The theater may be designed so that when in the boarding space, the passengers see no indication that they are in a motion simulation theater. After the passengers have boarded, the carrying apparatus is moved into a second or viewing position, where passengers view 2D or 3D visual images displayed on a screen. This movement may be achieved by lifting or lowering the passenger carrying apparatus from cables or chains attached to a lifting system near the top of the theater. In this design, the movement is substantially vertical. The passenger carrying apparatus typically has multiple rows of seats, which may tilt front to back, optionally with actuators behind the seats to create the impression of forward movement.

19 Claims, 10 Drawing Sheets

U.S. PATENT DOCUMENTS

| | | | |
|---|---|---|---|
| 5,791,903 | A | 8/1998 | Feuer et al. |
| 5,803,816 | A | 9/1998 | Moser et al. |
| 5,845,434 | A | 12/1998 | Hayashi |
| 5,947,828 | A | 9/1999 | Fabbri |
| 6,053,576 | A | 4/2000 | Jessee |
| 6,354,954 | B1 | 3/2002 | Sumner |
| 6,727,971 | B2 | 4/2004 | Lucas |
| 2005/0014567 | A1 | 1/2005 | Shenzhen |
| 2007/0193123 | A1 | 8/2007 | Magpuri |

MOTION SIMULATOR THEATER WITH SUSPENDED SEATING

BACKGROUND

The field of the invention is motion simulation and related theme park, entertainment and educational theaters and presentations. Various motion simulators and motion simulator theaters have been known and used in the past. Many of these are have elements similar to early flight simulators with one or a few participants seated on a motion base and facing a flat screen displaying simulated landscapes or airspace. More recently, motion simulation theaters have been developed with the capacity to hold much larger numbers of participants. Curved screens have also been used in these motion simulation theaters, along with special effects such as moving air and scents, so that the participants perceive a more realistic experience. Still, engineering and creative challenges remain in the design and operation of motion simulation theaters. Accordingly, it is an object of the invention to provide an improved motion simulation theater.

SUMMARY

A novel motion simulation theater has now been invented which provides for new and different movements, seat positioning, viewing angles, and other advantages. In a first aspect, this new theater may include a lifting apparatus that moves the theater seating via lifting lines. The lifting apparatus can be adapted to move the seating vertically from a boarding position to a viewing position. The lifting lines may be flexible, for example, cables or chains attached to a winch in the lifting apparatus, positioned at a vertical level above the screen. The theater may be designed so that the screen is not viewable from the seats when the seating is in the boarding position. The boarding position may be vertically above or below the viewing position. The screen may be flat, or curved in two or three dimensions. The lifting apparatus may move the seating from the boarding position to the viewing position through a cutout in the screen In another aspect, the seats may be attached to a rigid seating frame, with the lifting lines lifting and lowering the seating frame to position the seats as desired in the theater. The seats can be suspended on a seat link pivotally attached to the seating frame. The seating frame may be horizontal when in the boarding position, and then moved into an inclined position in the viewing position, via control of the lifting apparatus.

In yet another aspect, a method for entertaining or educating participants, in a theater setting, includes moving the participants vertically, from the boarding location to the viewing location. The lifting apparatus may also momentarily lift and lower the seats during the theater presentation, to exert acceleration forces on the participants. The participants may be seated in rows of seats, with seats closer to the screen above the seats behind them, to provide the participants with a less obstructed field of view of the screen.

Other and further objects and advantages will become apparent from the following detailed description and drawings. This detailed description is provided by way of example, and is not intended to limit the scope of the invention. The invention resides as well in sub-combinations of the elements and steps described.

BRIEF DESCRIPTION OF THE DRAWINGS

In the drawings, the same reference number indicates the same element in each of the views.

DEFINITIONS

The terms above and below refer to a vertical elevation or position, relative to gravity. These terms do not refer to horizontal positions, e.g., a first element may be above or below a second element while the first and second elements are entirely laterally or horizontally spaced apart from each other.

The term line refers to flexible tensile element, such as a cable, or to a winchable element, such as a chain. The term horizontal means perpendicular to the direction of gravity. The term attached means attached directly or indirectly through an intermediate element. The terms participant and viewer mean the person or persons perceiving one or more sensations provided by the theater. The terms program, presentation and media mean prerecorded or stored images displayed in a way perceptible to a viewer, including front or rear projected images, as well as images formed via any type of display (LED, OLED, plasma, hologram, etc.), with or without accompanying sound, scent, physical and/or tactile effects. The term screen also includes these types of displays. The terms half or hemi mean one half, or less than half, of a surface curving in three dimensions.

DETAILED DESCRIPTION OF THE DRAWINGS

Figure 1:
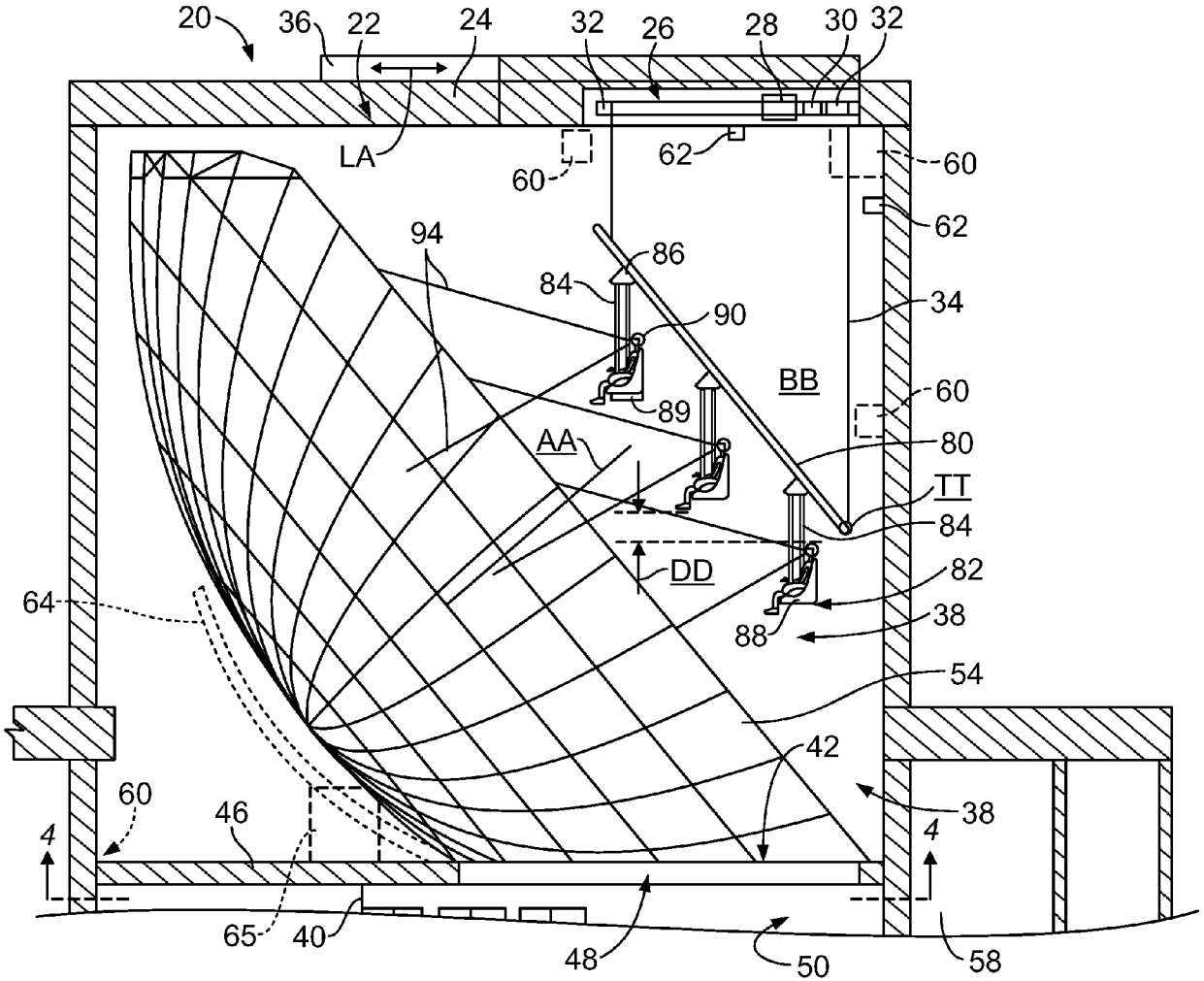
FIG. 1 is a side view of a new motion simulation theater, with the seats in a viewing position.
Figure 2:
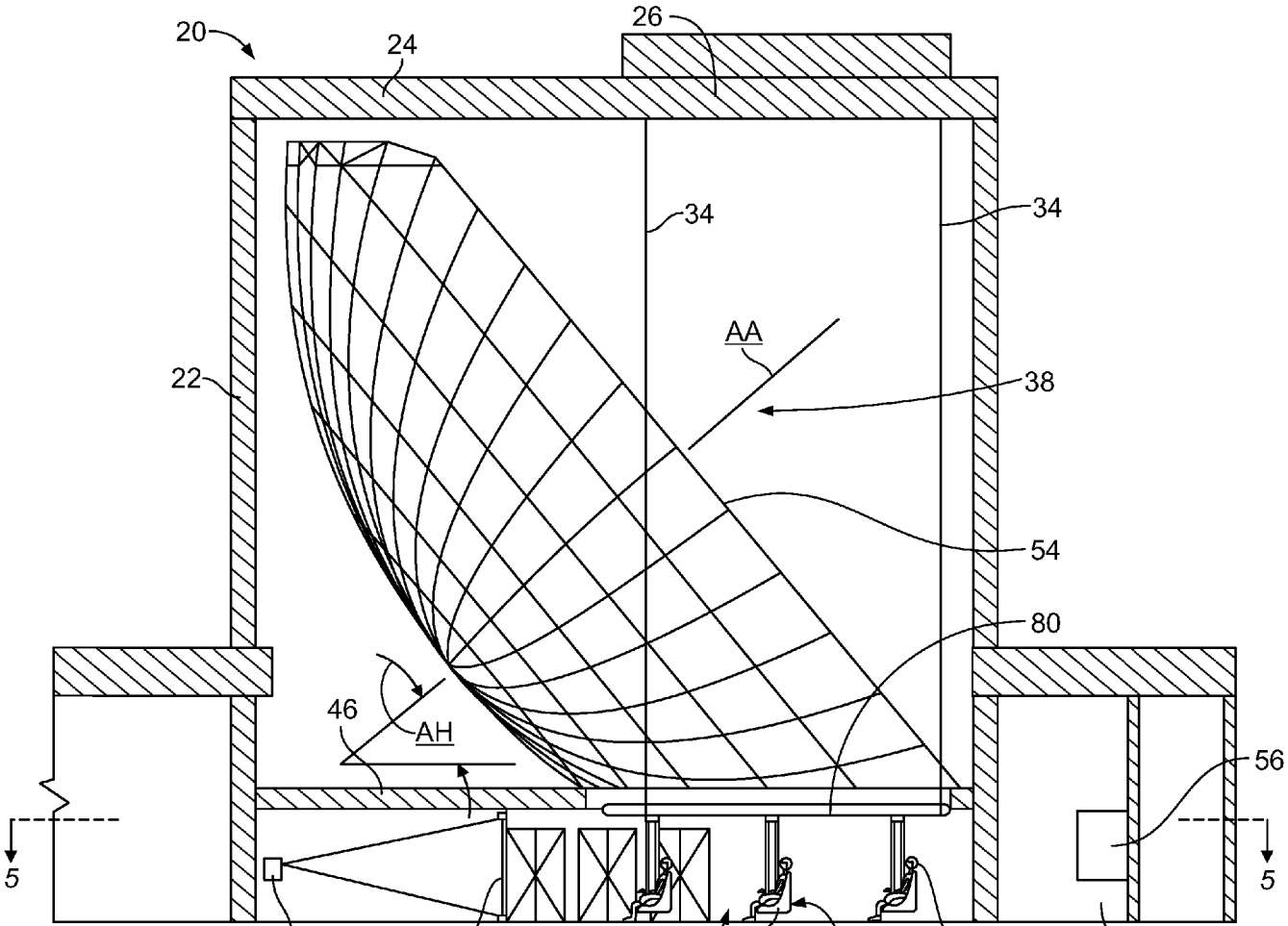
FIG. 2 is a side view of the theater shown in FIG. 1, with the seats in a boarding position.

Turning now in detail to the drawings, as shown in FIGS. 1 and 2, a motion simulation theater 20 is provided in a building or structure 22 having a screen 54 within a screen room or space 38. A lifting system 26 is supported on or by a ceiling structure 24 of the building 2. As shown in FIG. 1, the lifting system 26 may include one or more electric motors 28, gear drives 30 and winch rollers 32. A seating frame 80 is suspended on lines 34 attached to the lifting system, to allow the seating frame 80 to be moved vertically within the theater 20. Seats 88 are attached to or suspended from the frame 80. The seats 88 may be provided in rows 82. The seats 88 may be attached to the frame 80 at a pivot joint 86 via a rigid seat link or armature 84.

As shown in FIG. 1, the seat link 84 is dimensioned so that the nominal sight line 94 of a participant 90 is not blocked by another seat. The head of the participant 90 in a back row may be spaced below the feet of a participant in the next forward row by a dimension DD, ranging from about 10 to 150 cm (based on participants of standard height ranges). Alternatively, the seating surfaces of seats in adjacent rows may be vertically spaced apart by 200 or 220 cm up to about 300 cm, with the seats in the viewing position BB shown in FIG. 1.

One or more projectors 60, if used, are positioned to project images onto the screen. Conventional or rear projection projectors may be used. Projectors can be oriented to project images onto the screen or screens to create seamless, edge-blended images. Displays and other image forming techniques may also be used.

Sound speakers 62 are also provided in the screen room 38. The theater 20 may include surround sound audio components with a multi-channel system including a respective speaker unit on each channel of the system. The speaker system typically is placed in a central location, with each speaker unit facing to direct sound output in the respective direction toward an opposed wall surface, with the sound reflecting off the opposed wall.

An electronic controller 56 for controlling various elements of the theater may be provided in a control room 58 adjacent to the screen room 38. The electronic controller 56 may operate to integrate movement of the passenger seats 88 with action of the media presentation. The controller 56 may control operation of the lifting system 26. The controller may operate independently of, but in synchronization with the media presentation. Alternately, the controller 56 may be operatively integrated with the media presentation and operable in response to a signal or signals embedded in the media or transmitted from the projection system. The controller may be a microprocessor for which, in either case, the projector or projector system is cued by the microprocessor. The electronic control system thus will be synchronized with the sound and the projected media to give the passengers a vivid sensation of being completely immersed in the action on the screen.

Figure 3:
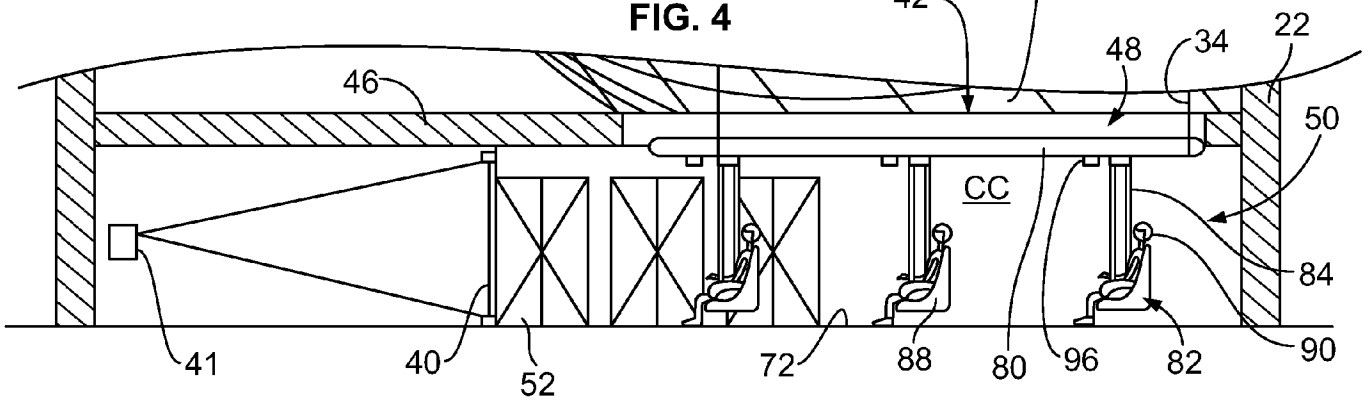
FIG. 3 is an enlarged view of the boarding area shown in FIG. 2.

Referring now to FIGS. 2 and 3, a boarding room or area 50 is provided below the screen 54. The boarding room 50 includes entry/exit doors 52, and may also have a pre-show media system, such as a projector 41 and a screen 40 at the front of the boarding room 50. An opening 48 is provided in the floor 46 of the screen room 38. The opening 48 may be generally sized and shaped to match the seating frame 80, as shown in FIG. 3. A cut-out 42 may be provided in the screen 54 above the opening 48, to allow the seating frame 80 to pass through from the boarding room 50 into the screen room 38. A movable partial screen 64 may be placed in the cut-out 42, except during passage of the seating frame 80, to provide a more expansive surface to form images on, during a presentation. The partial screen 64 may be moved out from the cut-out 42, for example by sliding on a track, by an actuator 65.

As shown in FIG. 3, with the seats 88 in the boarding position CC, the seats 88 are spaced up off the floor 72 at about the height of a typical chair, or slightly lower, to allow participants of varying height, including children, to readily seat themselves in the seats 88. The frame 80 may substantially close off the opening 48. Consequently, the participants 90 cannot then see into the screen room 38. The bottom surface of the frame 80 may be textured and colored to match the rest of the boarding room 50, so that the participants are not even made aware that the presentation provided in boarding room 50 (if used) is only a prelude to an entirely distinct and more thrilling presentation that follows in the screen room 38.

Figure 4:
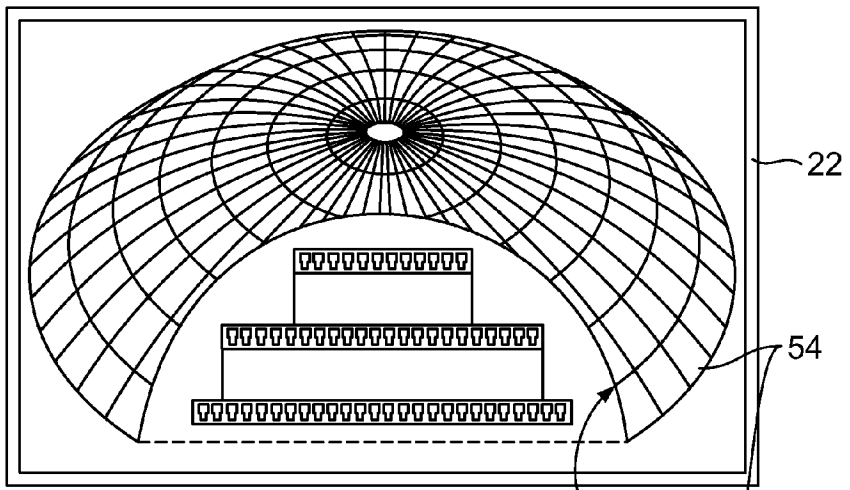
FIG. 4 is a view taken along line 4-4 of FIG. 1.
Figure 5:
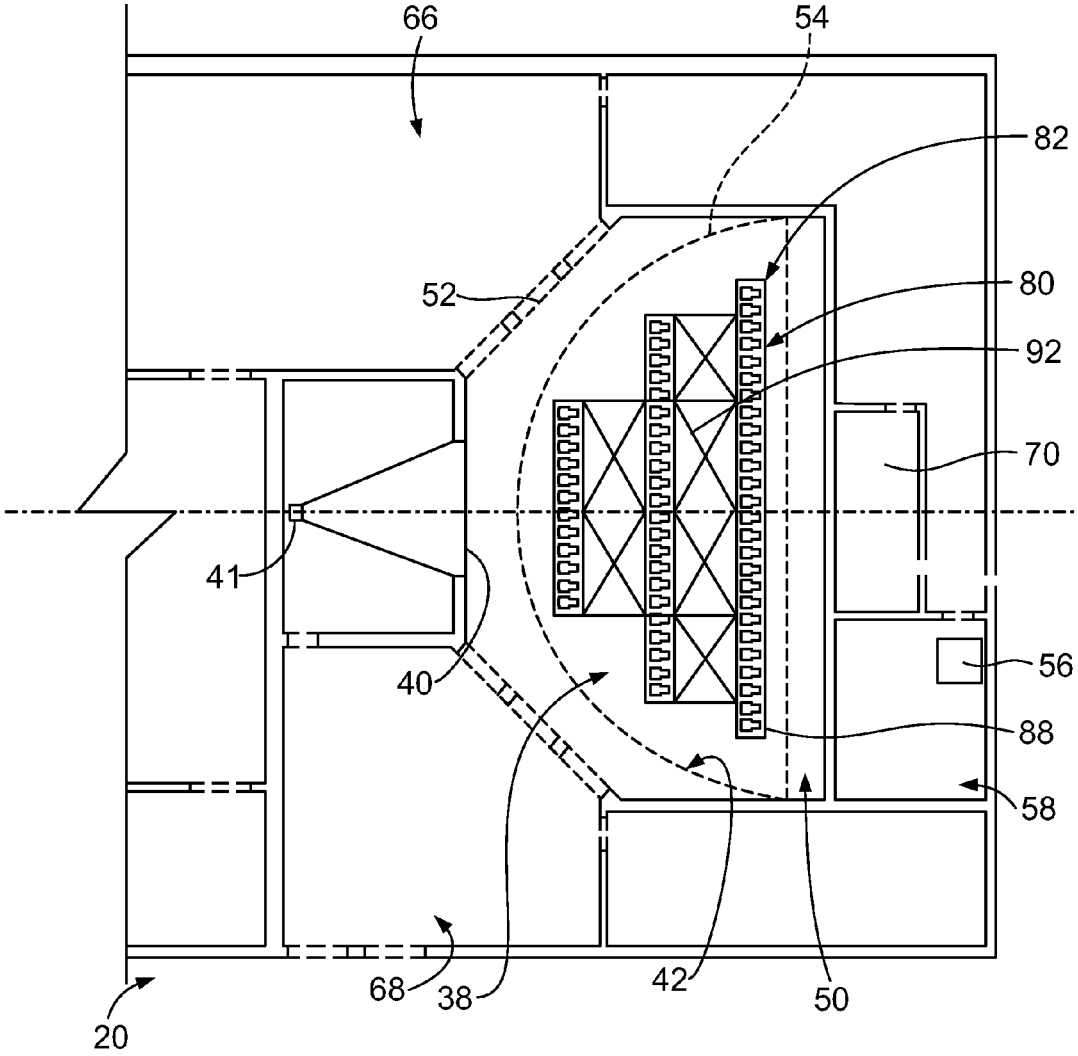
FIG. 5 is a view taken along line 5-5 of FIG. 2.

As shown in FIG. 3, rows 82 of seats 88 are spaced apart front to back sufficiently to allow for easy and rapid movement by participants into and out of the seats. As shown in FIG. 4, the length of the seat rows 82 may increase towards the back of the theater 20. Referring to FIGS. 3 and 5, the seats 88, or rows of seats 82, are suspended from the frame 80, which is typically a rigid structure with bracing elements 92 between the rows and elsewhere as may be needed. Special effects devices 96 may be provided on the frame 80 or on the seats 88 or seat links 84. The special effects devices 96 may include air movers, air heaters or chillers, scent emitters, water spray, ticklers, shakers, vibrators, etc. The seats 88 or seat rows 82 may be attached to the seat links on a pivot joint allowing the seats 88 to be pivoted forwardly or rearward by seat actuators, to provide a sensation of acceleration or deceleration.

Referring momentarily to FIG. 5, the theater 20 may optionally include a pre-board lobby 66 leading to the entry doors 52 of the boarding room 50. The pre-board lobby main include thematic elements and/or a pre-board live or recorded presentation. An exit hall 68 may be provided in the theater opposite from the pre-board lobby, to allow for one way viewer movement through the theater 20. A projection booth 70 may be centrally located at the back of the screen room.

In use, participants enter the boarding room 50 and sit in a seat 88. The participants secure themselves in place with a seat belt or harness, and/or a restraining bar. The electronic controller 56 may provide an indication that all participants are secured in place. A presentation may be provided in the boarding room via the projector 41 and screen 40, and/or via a live host. Alternatively, such a presentation made provided in the pre-board lobby 66.

After completion of any presentation made in the boarding room 50, the controller may initiate the main show. The partial screen 64, if used, is in the retracted position shown in FIG. 1. The lifting system 26 lifts the frame 80 from position CC shown in FIGS. 2 and 3, to the viewing of show position BB shown in FIG. 1. The lifting lines 34 lift the frame up. Multiple lifting lines 34 typically are used. This movement may initially be purely vertical movement. The screen room 38 may be dark during this movement. Alternatively, this movement may occur shortly after the presentation is initiated, providing a sensation of launching and upward vertical movement or flying.

The lifting system 26 is adapted to lift the entire frame up, and also to tilt the frame 80 into the inclined position shown in FIG. 1. The lifting system 26 may achieve the tilt via winching speed obtained by motor control and/or by winch ratios. Consequently, the tilting movement may be continuous and linear from position CC to position BB, or the frame 80 may remain horizontal while it is lifted partially or fully to position BB, with the tilting occurring only after the back end of the frame 80 has reached a final vertical position. The tilting movement may occur about an axis TT at the back end of the frame 80, moving the seats 88 in an arc up and away from the screen 40.

As the tilting movement occurs, the front and any middle lift lines may move rearward on the winches 32, while the back lift lines 34 remain stationary. The seats 88 remain level via the pivot attachment 86 between the seat links 84 and the frame 80, notwithstanding the tilting of the frame. With the frame angled upwardly in elevation towards the screen as shown at position BB in FIG. 1, the seats 88 are in a reverse stadium seating configuration (with the highest seats closest to the screen and the lowest seats furthest away from the screen).

The theater 20 may optionally include a lifting system longitudinal actuator 36 that moves the lifting system 26 in the direction of arrow LA in FIG. 1. This allows the seats to be moved towards and away from the screen 54, when the seats are in the viewing position BB.

With the frame in position BB, the presentation in screen room 38 begins, and only then may the participants realize that they are now in an elevated position and surrounded by images, providing a thrilling and immersive effect. If used, the partial screen 64 is moved into the screen cutout 42. In the design shown in FIG. 1 having a screen curving in three dimensions, the participant's line of sight is substantially surrounded or enveloped by the images on the screen, due to the participant's elevated position.

Actuators on the seats 88, seat links 84 or on the frame 80 may provide physical effects such as seat pitch, roll, yaw or heave, similar to motion base movements, in coordination with the images on the screen. In addition, the lifting system 26 may be actuated during the presentation to accelerate the participants up or down. Since the lifting system can provide a very large range of vertical movements, acceleration effects can be achieved that are not achievable with conventional motion simulation theaters. For example, acceleration may be sustained for longer time intervals in comparison to conventional techniques.

At the end of the presentation, the lifting system 26 reverses direction and returns the frame 80 back to position CC shown in FIGS. 2 and 3. This movement may also occur with the screen room and the boarding room dark. With the frame and the seats returned to boarding position, the participants release their seat restraints and exit the theater. The theater 20 is then ready for boarding by a next group of participants.

Figure 6:
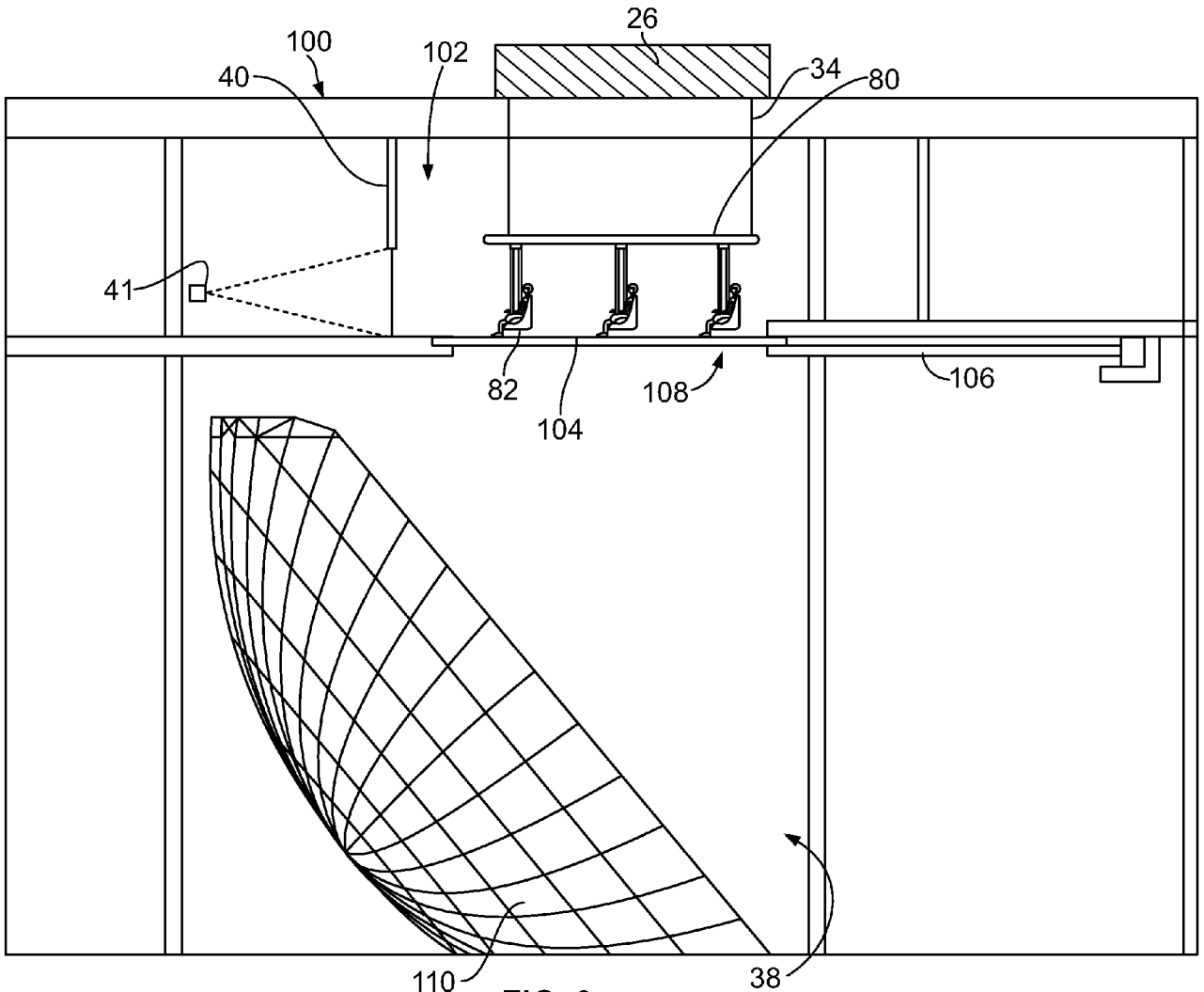
FIG. 6 is a side view of a second embodiment of a new motion simulation theater, with the seats in a boarding position.
Figure 7:
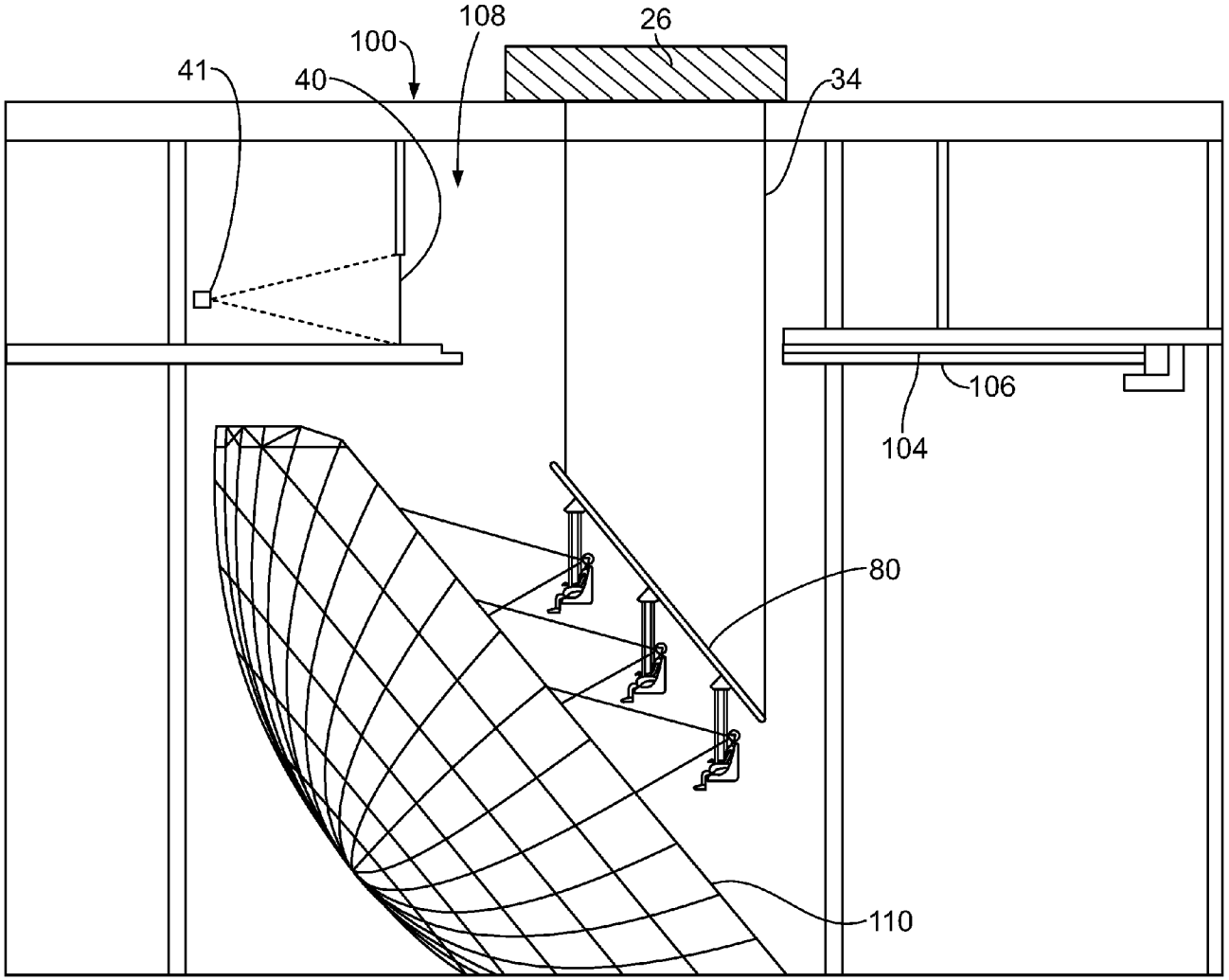
FIG. 7 is a side view of the theater of FIG. 6, with the seats in a viewing position.

FIGS. 6 and 7 show another theater 100 similar to the theater 20, but with a boarding room 102 above the screen room 38. The boarding room 102 may have a sliding floor 104 moved by a floor actuator 106. After the participants 90 are secured into their seats 88, the floor actuator 106 retracts the sliding floor 104. The frame 80 is then lowered into the screen room 38. The theater 100 may otherwise operate in the same way as the theater 20 described above. The lifting system longitudinal actuator 36 may be used in the theater 100, in place of the sliding floor 104. In this embodiment, the participants or riders board the seats in a boarding room having a fixed floor. The seats are then moved into alignment over a cutout or opening at or near the top of the screen room 38. Then, the seats are lowered into the viewing position via the lifting system.

Figure 8:
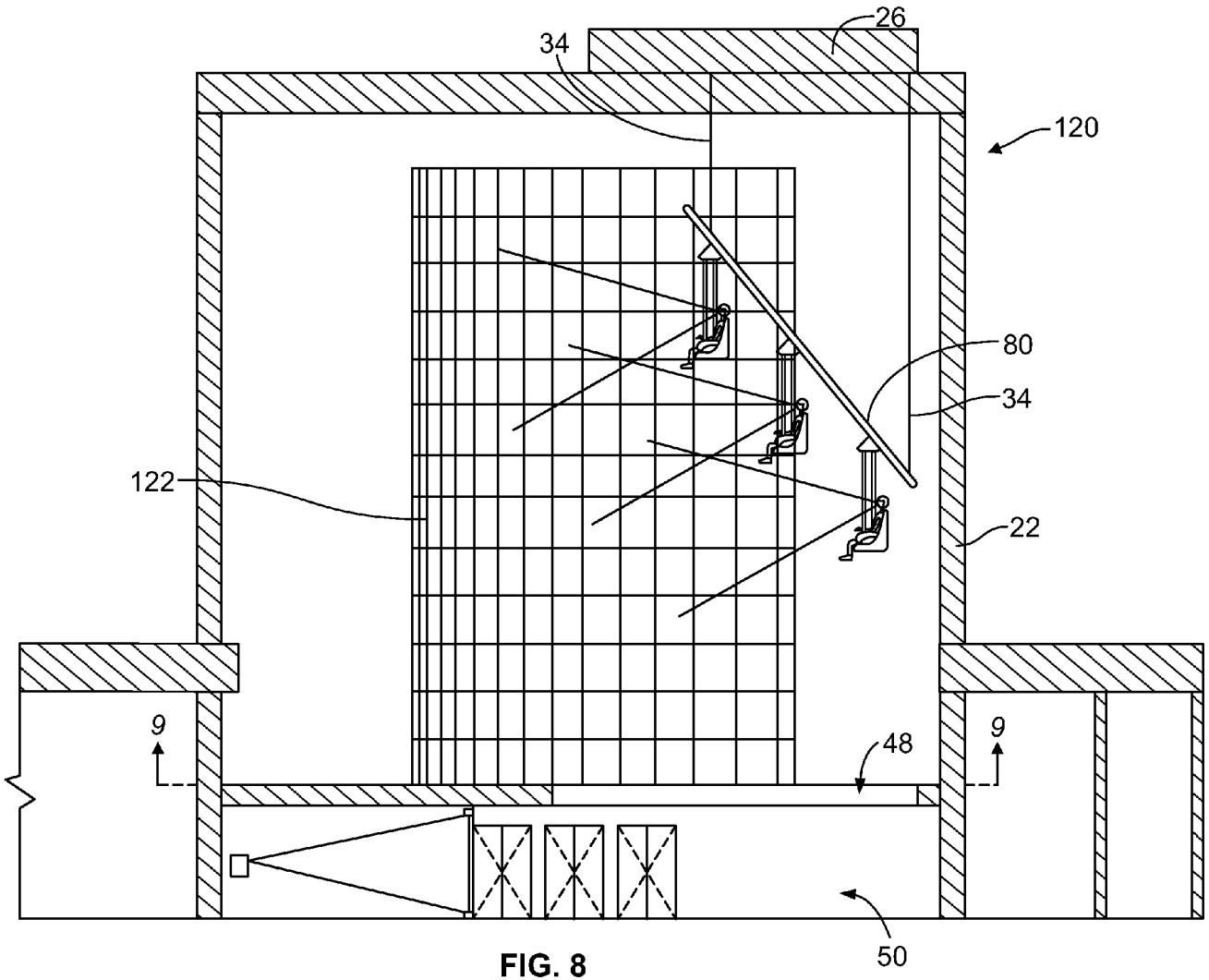
FIG. 8 is a side view of a third embodiment of a new motion simulation theater, with the seats in a viewing position.
Figure 9:
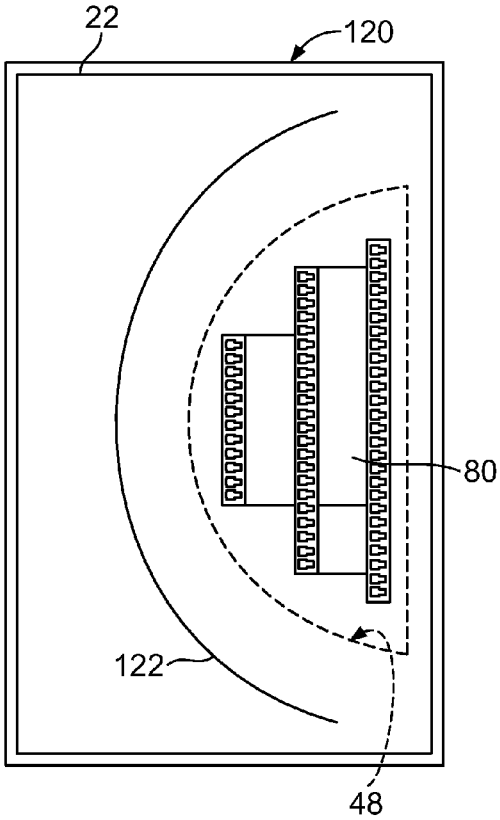
FIG. 9 is a view taken along line 9-9 of FIG. 8.

FIGS. 8 and 9 show another theater 120 which may be the same as the theater 20, except that a cylindrical screen 122 is used in place of the half-dome screen shown in FIGS. 1 and 2. The half dome screen in FIGS. 1 and 2 may be hemi-spherical, ovoid, elliptical, or have another shape curving in three dimensions, while the screen in FIGS. 8 and 9 curves in two dimensions. The angle of the central axis M of the dome screen 54 shown in FIG. 2 may vary with the configuration of the screen room 38. The screen axis angle AH shown in FIG. 2 may typically range from about 35 to 65 degrees. As shown in FIG. 1, with the frame in position BB, the central screen axis AA generally bisects the frame 80.

Figure 11:
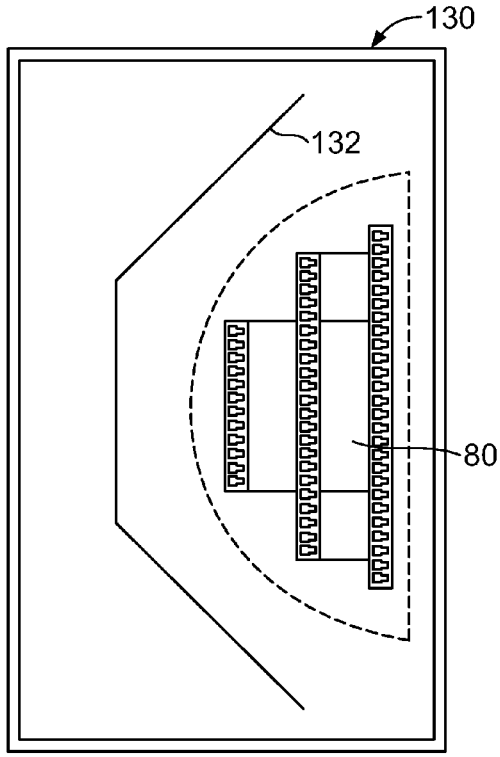
FIG. 11 is a view taken along line 11-11 of FIG. 10.
Figure 10:
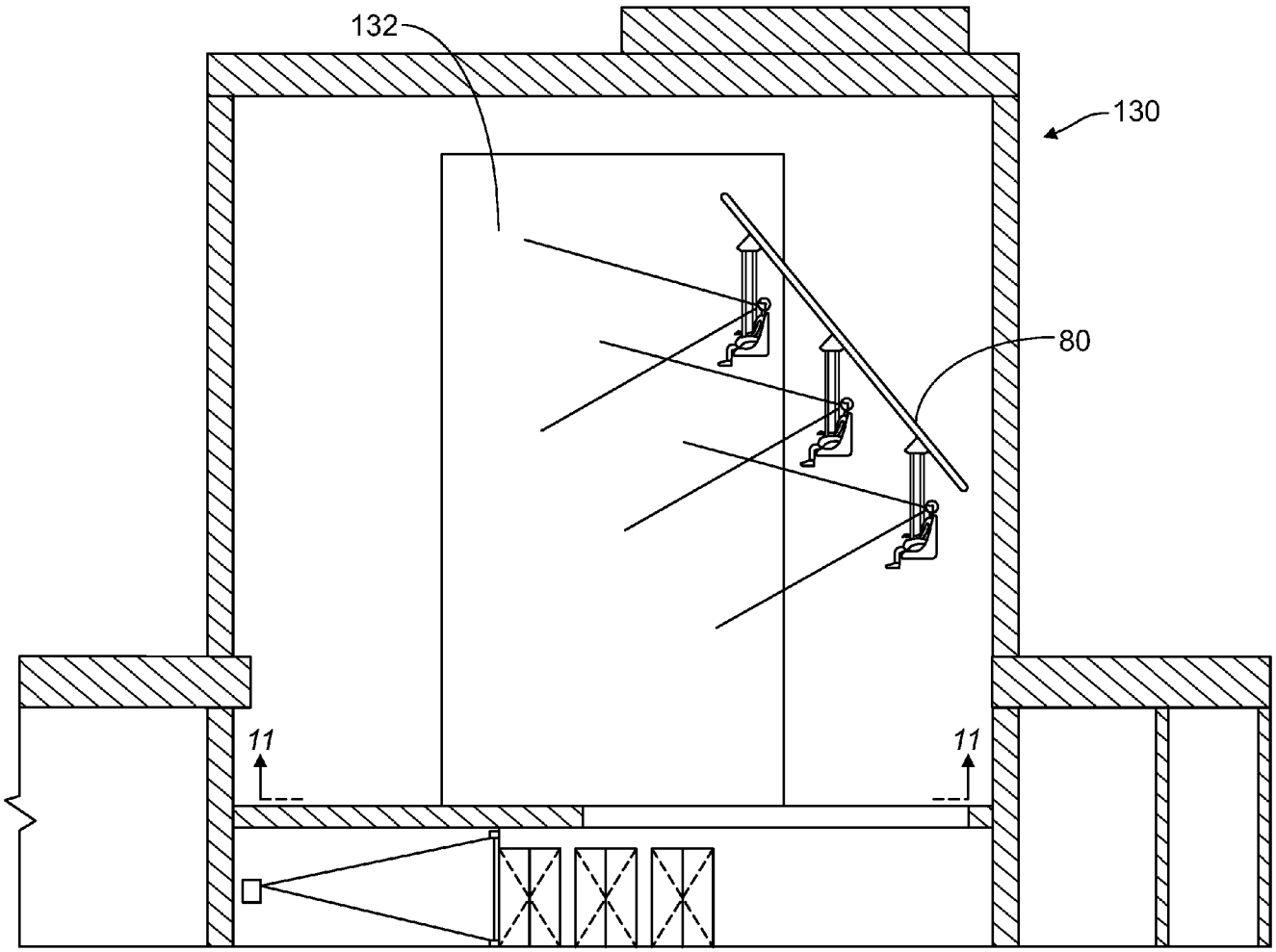
FIG. 10 is a side view of a fourth embodiment of a new motion simulation theater, with the seats in a viewing position.

FIG. 10 shows another theater 130 which may be the same as the theater 20, except that one or more flat screens 132 are used. As shown in FIG. 11, three flat screens may be joined to each other in essentially a half hexagon shape.

Figure 12:
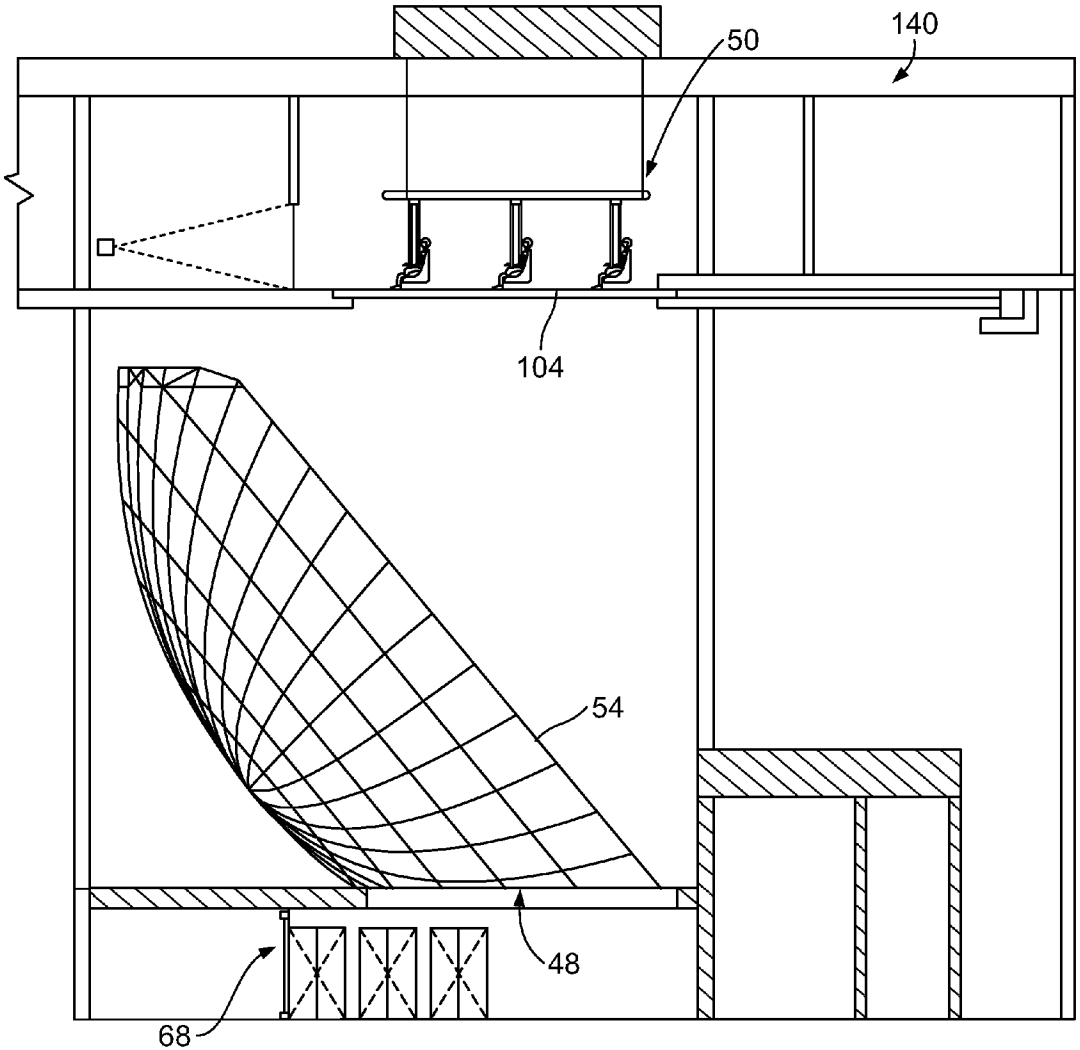
FIG. 12 is a side view of a fifth embodiment of a new motion simulation theater, with the seats in a boarding position.

FIG. 12 shows another embodiment similar to the theater 100 shown in FIGS. 6 and 7, but with a boarding room 50 above the screen room 38 and a de-boarding exit hall 68 below the screen room. In this design, participants enter at an upper level and exit at a lower level.

The motion simulation theater 20 is designed and constructed provide a sensory immersion and/or a motion simulation experience to an audience. The theater may be designed to create the initial impression to the audience of being in a standard non-motion theater, thus providing an element of surprise when the main screen 54 in the screen room 38 is revealed and the seats 88 begin to rise, creating the sensation of launching into flight. The theater may also be adapted to provide synchronized motion of the participants with special effects, including, visceral, tactile and audible sensations which simulate flight through a particular environment, storyline, experience, and/or activity.

Thus, various embodiments of a new motion simulation theater have been shown and described. Various changes and substitutions may of course be made without departing from the spirit and scope of the invention. The invention, therefore, should not be limited, except by the following claims and their equivalents.

The invention claimed is:

1. A theater comprising:

a screen;

at least one projector for projecting images onto the screen;

seating apparatus including seats for viewers to sit on;

lifting apparatus attached to the seating apparatus via cables or chains attached adjacent to front and back ends of the seating apparatus, with the lifting apparatus adapted to move the seating apparatus substantially vertically from a boarding position to a viewing position.

2. The theater of claim 1 with the lifting apparatus comprising a winch positioned at a vertical level above the screen.

3. The theater of claim 1 wherein the viewing position is closer to a central axis of the screen than the boarding position.

4. The, theater of claim 1 with the seating, apparatus including a frame with each of the seats attached to and suspended from the frame on a seat link.

5. The theater of claim 4 with the seals pivotally attached to a lower side of the frame.

6. The theater of claim 4 with the seats arranged in a first row and in a second row, with the seats in the first and second rows both facing forward in a first direction, with the second row behind the first row, and with the second row having more seats than the first row.

7. The theater of claim 6 with the frame having a first end and second end, and with first row of seats attached adjacent to a first end of the frame, and with the first end of the frame closer to the screen than the second end.

8. The theater of claim 1 with the boarding position vertically below the viewing position.

9. The theater of claim 1 with the boarding position vertically above the viewing position.

10. The theater of claim 8 with the screen curving in three dimensions, and with the seating apparatus movable from the boarding position to the viewing position through a cutout in the screen.

11. The theater of claim 1 with the screen comprising substantially a half-dome having a central axis extending at an inclined angle.

12. The Theater of claim 1 further comprising one more seat actuators on the frame for moving the seats.

13. A method for entertaining or educating, comprising:

confirming that participants are secured in place, while the participants are, in a boarding location;

moving the participants vertically, from the boarding location to a viewing location, with the participants facing a screen when in the viewing location, and with the participants seated in a seating frame which is suspended on cables or chains and is substantially unrestricted from front-to-back and side-to-side movement;

displaying images on the screen; and moving the participants vertically back to the boarding location.

14. The method of claim 13 further comprising moving the participants only substantially vertically and in a straight line.

15. The method of claim 13 with the participants seated in at least a first row and a second row of seats, with the first row of seats closer to the screen than the second row of seats, and further comprising positioning the first row of seats above the second row of seats, when the participants are in the viewing location.

16. The method of claim 13 further comprising moving the participants vertically through a cutout in the screen.

17. The method of claim 13 wherein the screen is hidden from the participants when the participants are in the boarding location.

18. The method of claim 13 with boarding location in a first room and the viewing location in a second room above or below the first room.

19. The method of claim 13 further comprising maintaining the seating frame in a horizontal orientation.

* * * * *